US005246910A

United States Patent [19]

Koshizuka et al.

[11] Patent Number: 5,246,910

[45] Date of Patent: Sep. 21, 1993

[54] IMAGE-RECEIVING SHEET FOR THERMAL TRANSFER RECORDING AND A THERMAL TRANSFER RECORDING METHOD

[75] Inventors: Kunihiro Koshizuka; Shigehiro Kitamura; Atsushi Nakajima; Tomonori Kawamura; Toshihisa Takeyama, all of Hino, Japan

[73] Assignee: Konica Corporation, Tokyo, Japan

[21] Appl. No.: 851,851

[22] Filed: Mar. 16, 1992

[30] Foreign Application Priority Data

Mar. 22, 1991 [JP] Japan ..... 3-058775

[51] Int. Cl.[5] ..... B41M 5/035; B41M 5/38

[52] U.S. Cl. ..... 503/227; 428/195; 428/212; 428/341; 428/913; 428/914

[58] Field of Search ..... 8/471; 428/195, 913, 428/914; 503/227

[56] References Cited

U.S. PATENT DOCUMENTS 4,775,657 10/1988 Harrison et al. ..... 503/227

OTHER PUBLICATIONS

Database WPIL, No. 90-63260, Derwent Publications, London JPA-2016088; Jan. 19, 1990.

*Primary Examiner*—B. Hamilton Hess

*Attorney, Agent, or Firm*—Jordan B. Bierman

[57] ABSTRACT

A thermal transfer recording image-receiving sheet is disclosed. The sheet comprises a support and provided thereon, an image receiving layer comprising a metallic ion-containing compound. A concentration of the metallic ion-containing compound at a portion closer to the support is higher than that of the metallic ion-containing compound at a portion farther to the support.

9 Claims, No Drawings

IMAGE-RECEIVING SHEET FOR THERMAL TRANSFER RECORDING AND A THERMAL TRANSFER RECORDING METHOD

FIELD OF THE INVENTION

The present invention relates to an image-receiving sheet for thermal transfer recording and a thermal transfer recording method which uses the same, and more particularly to an image-receiving sheet for thermal transfer recording which is capable of providing a dye-unevenness-free and excellent preservability-having image with a high transfer density, and a thermal transfer recording method which enables to discretionally vary the form of the image-recording surface.

BACKGROUND OF THE INVENTION

For obtaining color hard copies there have hitherto been studied color recording techniques employing ink-jet process, electrophotographic process and thermal transfer process. Of these processes, the thermal transfer process is advantageous in that it can be easily operated and maintained, enables the use of a compact-sized device therefor for cost reduction, and can be run at a low cost.

The thermal transfer process is classified into two: one is a heat melt transfer process in which a transfer sheet comprising a support having thereon a heat-fusible ink layer (hereinafter referred to as thermal transfer recording material) is heated by a thermal head to transfer the ink from the heat-fusible ink layer onto an image-receiving sheet for thermal transfer recording and the other is a heat diffusion transfer process (heat sublimate process) in which a transfer sheet comprising a support having thereon a heat-diffusible dye (sublimable dye)-containing ink layer is heated by a thermal head to transfer the heat-diffusible dye from the ink layer onto an image-receiving sheet for thermal transfer recording. Of the above two, the latter is more advantageous for full-color recording because it can vary the transferring amount of the dye according to changes in the thermal energy of the thermal head to thereby enable the control of image gradation.

In the thermal transfer recording in the heat-diffusion transfer process, a dye used in a thermal transfer recording material plays an important role, but has the disadvantage that it cannot attain the image stability that is obtained by a conventional dye; i.e., an image formed by the heat-diffusion transfer process is inferior in the resistance to light and the fixability.

In order to improve these points, JP O.P.I. Nos. 78893/1984, 109394/1984 and 2398/1985 disclose image forming methods for forming a chelated dye image on a thermal transfer recording sheet by using a chelatable heat-diffusible dye.

Although these image forming methods are satisfactory for improving the heat resistance and fixability, the diffusion or chelating of the dye coming at the time of thermal transfer from the thermal transfer recording ink sheet thereof is not sufficient in conventional image-receiving sheets to thus form an image lacking in uniformity.

In addition, because the chelated dye is present in the image-receiving layer surface, the formed image has no sufficient resistance to light to thus make it difficult to retain the initial image quality obtained at the time of image formation. Further, where a large amount of a metallic ion-containing compound is present on the image-receiving layer surface, there occur problems that in the image formation with the heat-diffusible thermal transfer recording ink sheet, the dye of the ink layer and its binder together are liable to be transferred (fused) to thus lower the surface gloss of the image recording surface, or the metallic ion-containing compound, at the time of recording, is transferred counter from the image-receiving layer to the ink sheet side, resulting in loss of the image transfer density.

SUMMARY OF THE INVENTION

It is an object of the invention to provide a thermal transfer recording image-receiving sheet improved on the transfer density, image uniformity and image preservability, and a thermal transfer recording method which enables to discretionarily vary the surface form of an image recording material.

The above object of the invention is accomplished by a thermal transfer recording image-receiving sheet comprising a support and, provided thereon, an image-receiving layer comprising a metallic ion-containing compound, wherein a concentration of the metallic ion-containing compound at a portion closer to the support is higher than that of the metallic ion-containing compound at a portion farther to the support. The above sheet preferably is that the image-receiving layer is composed of a plurality of sublayers comprising a metallic ion-containing compound or a concentration of the metallic ion-containing compound in the outermost sublayer of the plurality of sublayers is substantially zero. Further, the above object is accomplished by a thermal transfer recording method comprising the steps of superposing a thermal transfer recording image-receiving sheet upon a thermal transfer recording ink sheet comprising a support having thereon a heat-diffusible dye-containing ink layer, so that the image-receiving layer comes in contact with the ink layer, imagewise applying heat to the superposed materials to transfer the ink layer to the image-receiving sheet and form the image on the image-receiving sheet, and applying heat to the formed image, said thermal transfer recording image-receiving sheet comprising a support and, provided thereon, an image-receiving layer comprising a metallic ion-containing compound, wherein a concentration of the metallic ion-containing compound is higher at a portion closer to the support.

DETAILED DESCRIPTION OF THE INVENTION

The invention is described in detail below:

(1) Thermal Transfer Recording Image-Receiving Sheet

The thermal transfer recording image-receiving sheet of the invention basically comprises a support having thereon an image-receiving layer.

Support

Materials usable as the support include paper and various other papers such as coated papers, synthetic papers made of polypropylene and polystyrene, and papers laminated therewith; various plastic films or sheets made of vinyl chloride resin, ABS resin, polyethylene terephthalate and polyethylene naphthalate; various metals in the film or sheet form; and various ceramics in the film or sheet form.

To the support, in order to increase the clearness of an image that is to be formed in the later process, is preferably added a white pigment such as titanium white, magnesium carbonate, zinc oxide, barium sulfate, silica, talc, clay, calcium carbonate or the like.

The thickness of the support is in the range of normally 20 to 1,000 μm, preferably 20 to 800 μm. and discretionally selected from the range.

Image-Receiving Layer:

The image-receiving layer is formed with a binder for image-receiving layer, a metallic ion-containing compound and various additives used as needed.

In the invention, it is important for the image-receiving layer to have a higher metallic ion-containing compound concentration in the proximity of the support. When the metallic ion-containing compound in the image-receiving layer is present at a higher concentration on the side closer to the support, the thermal transfer recording sheet can exhibit a highly uniform image formability and a high image preservability. Exertion of the above effect can be made by using materials discretionarily selected from hereinafter described binders, metallic ion-containing compounds and other additives for the image-receiving layer, adjusting the using amounts of these materials, or adjusting the thickness of the image-receiving layer.

1. Binder for image-receiving layer

In general, examples of the binder for the image-receiving layer include polyvinyl chloride resins, copolymer resins of vinyl chloride with other monomers such as an alkylvinyl ether. allylglycidyl ether, vinyl propionate, etc., polyvinylidene chloride resins, polyester resins, acrylates, methacrylates, epoxy resins, phenoxy resins, polyvinyl butyral, polyvinyl pyrrolidones, polycarbonates, polysufones, polyallylates, polyparabanic acid, cellulose triacetate, styrene acrylate resins, vinyltoluene acrylate resins, polyurethane resins, polyamide resins, urea resins, polycaprolactone resins, styrene-maleic anhydride resins, polyacrylonitrile resins and polyolefin resins such as polyethylene and polypropylene. The preferred as the binder of the image-receiving layer of the invention are the vinyl chloride resins, epoxy resins, phenoxy resins, polybutyral, and polyolefin resins such as polyethylene and polypropylene.

Where an image-receiving layer is composed of a plurality of sublayers, the binder used in any of the sublayers may be the same and is not necessarily a specific one.

These resins may be used alone or in combination.

The resin used may be either a newly synthesized one or a commercially available one.

In forming the image-receiving layer, the above resin, utilizing its reaction active site (providing a reaction active site thereto if none), may be crosslinked or hardened by a radiation, heat, moisture or a catalyst.

In this instance, a radiation-active monomer such as epoxy or acryl, or a crosslinking agent such as an isocyanate may be used.

2. Metallic Ion-Containing Compound

Examples of the metallic ion constituting the above metallic ion-containing compound include divalent or multivalent ion of metals belonging to Groups I to VIII of the periodic table, but the preferred among these are ions of Al, Co, Cr, Cu, Fe, Mg, Mn, Mo, Ni, Sn, Ti and Zn, particularly Ni, Cu, Co Cr and Zn.

The preferred as the metallic ion-containing compound is an ionorganic or organic salt or a complex of the above mentioned metal; for example, a complex compound containing $Ni^{2+}$, $Cu^{2+}$, $Co^{2+}$, $Cr^{2+}$ and $Zn^{2+}$ represented by the following formula may be suitably used.

$$[M(Q_1)_k(Q_2)_m(Q_3)_n]^{p+}.p(L^-)$$

wherein M represents a metallic ion; $Q_1$, $Q_2$ and $Q_3$ each represent an coordination compound capable of coordinate-bonding with a metallic ion represented by M, wherein the coordination compound may be one selected from the coordination compounds described in, e.g., the 'Kireito Kagaku (5)' ('Chelate Chemistry (5)'). published by Nankodo Co., particularly preferably coordination compounds each having at least one amino group capable of coordinate-bonding with a metal, and more particularly ethylenediamine and derivatives thereof, glycinamido and derivatives thereof, and picolinamido and derivatives thereof;

$L^-$ is an anion capable of forming a complex, examples of which include anions of inorganic compounds such as Cl, $SO_4$ and $ClO_4$ and anions of organic compounds such as benzenesulfonic acid derivatives and alkylsulfonic acid derivatives, and particularly preferably tetraphenyl borate anion and derivatives thereof and alkylbenzenesulfonic acid anion and derivatives thereof;

k is an integer of 1, 2 or 3; m is an integer of 0, 1 or 2; n is an integer of 0 or 1, provided these integers are determined according to whether the complex represented by the above formula is tetradentate or hexadentate or according to the number of ligands $Q_1$, $Q_2$ and $Q_3$; and p is an integer of 1, 2 or 3.

Particular examples of the metallic ion-containing compound described above include those exemplified in U.S. Pat. No. 4,987,049, JP O.P.I. Nos. 217906/1989 and 244539/1989.

The adding amount of the metallic ion-containing compound to the image-receiving layer is preferably 0.5 to 20 g/m$^2$, more preferably 1 to 15 g/m$^2$.

3. Additives

To the image-receiving layer may be added additives such as a peeling agent, antioxidation agent, UV absorbent, light stabilizer, filler (inorganic particles or organic resin particles), and pigment. Also, a plasticizer or heat-melting agent may be added as a sensitizer.

The peeling agent is for improving the peelability of the thermal transfer recording ink sheet and the thermal transfer image-receiving sheet, and, in the invention, preferably incorporated into the outermost layer.

Examples of the peeling agent include silicone oils (including those called silicone resins); solid waxes such as polyethylene wax, amide wax, teflon powder, etc.; and fluorosurfactants and phosphate surfactants. The preferred among these are silicone oils and polyethylene wax. Polyethylene wax is preferably one having a softening point of 50° to 150° C. and an average molecular weight of 1000 to 20,000.

In the case of the simply adding type, in order to improve the compatibility thereof with the binder, there may be used preferably modified silicone oils such as polyester-modified silicone resin, urethane-modified silicone resin and acryl-modified silicone resin.

The adding amount of the simply adding-type silicone oil cannot be uniformly determined because it differs depending on the kind used, but is generally 0.1 to 50% by weight of the binder of the image-receiving layer, preferably 0.5 to 20% by weight.

Examples of the hardening/reaction-type silicone oil include reaction-hardenable silicone oils (hardened by the reaction between, e.g., amino-modified silicone oil and epoxy-modified silicone oil), light-hardenable-type silicone oils and catalyst-hardenable-type silicone oils.

The adding amount of these hardenable-type silicone oils to the binder of the image-receiving layer is preferably 0.5 to 30% by weight.

When dye affinity and retention of the above peeling agent is sufficient, an image-receiving layer may be composed of the peeling agent alone.

The uppermost layer of the image-receiving layer may be provided by coating a liquid of the peeling agent dissolved or dispersed in an appropriate solvent and then drying.

Examples of the aforementioned antioxidation agent include the antioxidation agents described in JP O.P.I. Nos. 182785/1984, 130735/1985 and 127387/1989 and compounds known as useful for improving the image preservability of photographic and other image recording materials.

Examples of the aforementioned UV absorbent and light stabilizer include the compounds described in JP O.P.I. Nos. 158287/1984, 74686/1988, 145089/1988, 196292/1984, 229594/1987, 122596/1988, 283595/1986 and 204788/1989 and compounds known as useful for improving the image preservability of photographic and other image recording materials.

Usable as the foregoing filler are inorganic particles and organic resin particles.

Examples of the above inorganic particles include particles of silica gel, calcium carbonate, titanium oxide, acid clay, active clay and alumina, and those of the organic resin particles include particles of fluororesin, guanamine resin, acryl resin and silicone resin. The adding amount of these inorganic and organic resin particles, although it depends on the specific gravity thereof, is preferably from 0 to 30% by weight.

Examples of the aforementioned pigment include titanium white, calcium carbonate, zinc oxide, barium sulfate, silica, talc, clay, kaolin, active clay and acid clay.

Examples of the aforementioned plasticizer include phthalates, trimellitates, adipates, saturated and unsaturated carboxylates, citrates, epoxylated soybean oil, epoxylated inseed oil, epoxystearates, orthophosphates, phosphites and glycol esters.

In the invention, the total amount of all the additives added to the binder of the image-receiving layer is in the range of from 0.1 to 30% by weight.

Other Layers

The image-receiving layer and the support may have an intermediate layer (subbing layer) therebetween for the purpose of providing characteristics such as adiabaticity, barrier characteristic, cushiony characteristic and adhesiveness.

The image-receiving layer may have on its surface an overcoat layer for the purpose of preventing the thermal transfer recording image-receiving sheet from sticking to the thermal transfer recording ink sheet.

On the backing side of the support opposite to the image-receiving layer may be provided a backing layer for antistatic and anticurl purposes.

The above intermediate layer, overcoat layer and backing layer each have a thickness of normally from 0.1 to 20 μm.

(2) Preparation of Thermal Transfer Recording Image-Receiving Sheet

The thermal transfer recording image-receiving sheet can be formed by a coating method in which the foregoing image-receiving layer forming constituents are dispersed or dissolved in a solvent to prepare a coating liquid for the image-receiving layer formation, and the coating liquid is then coated on the surface of a support and then dried, or by a laminating method in which a mixture of the above image-receiving layer forming constituents is molten to be extruded and laminated on a support. Of these methods, the coating method is preferred.

Examples of the solvent used in the above coating method include water; alcohols such as ethanol and propanol; cellosolves such as methyl cellosolve and ethyl cellosolve: aromatic solvents such as toluene, xylene and chlorobenzene; ketones such as acetone and methyl-ethyl ketone; ester solvents such as ethyl acetate and butyl acetate; ethers such as tetrahydrofuran and dioxane; and chloro solvents such as chloroform and trichloroethylene.

The coating in the above coating method may be carried out by using a conventionally known gravure roll coating, extrusion coating, wire bar coating or roll coating process.

In the image-receiving layer, for making the metallic ion-containing compound concentration higher as it becomes closer to the support, in the case of the above coating method, there are a method in which the metallic ion-containing compound, before the solvent is completely dried out, is settled down by a centrifuge toward the support side and a method for increasing the concentration of the metallic ion-containing compound on the support side by electrophoresis. However, a more preferred method is such that on a support is coated a first image-receiving layer coating liquid containing a metallic ion-containing compound in a certain concentration, on which is then coated a second image-receiving layer coating liquid containing the above compound in a concentration lower than the above concentration, thus repeating this procedure discretional times to step-by-step form layers in which the compound concentration gradually decreases.

In this instance, if the first image-receiving layer coating liquid is coated on the support and completely dried and then on the dried layer is coated the second image-receiving layer coating liquid, then the image-receiving layer can be of a double-layer structure having metallic ion-containing compound concentrations clearly different from each other at the layer interface thereof. If the second image-receiving layer coating liquid is coated on the first image-receiving layer not sufficiently dried yet, then the cross-diffusion of the respective coating liquids' constituents occurs at the interface between the first and second image-receiving layer coating liquids to thus result in no definite interface between the first image-receiving layer and the second image-receiving layer, and therefore, in the image-receiving layer comprised of such the first and second layers, the concentration of the metallic ion-containing compound gradually increases toward the support side. Alternatively, if the first image-receiving layer coating liquid is coated on a support and completely dried and then on the dried layer is coated the second image-receiving layer coating liquid containing a solvent capable of dissolving the composition of the coated first image-receiving layer, then the dissolution and diffusion of the first image-receiving layer's composition occurs at the interface, thus resulting in disappearance of the definite interface between the first image-receiving layer and the second image-receiving layer to cause the metallic ion-containing compound concentration to gradually increase toward the support side. The image-receiving layer may be of a triple or multi-layer structure, not limited to the above double-layer structure. The image-receiving layer may be formed either over the entire area or on a partial area of the support. From the standpoint of ease of manufacturing, the image-receiving layer is preferably a double layer.

(3) Thermal Transfer Recording Ink Sheet

The thermal transfer recording ink sheet basically comprises a support having thereon an ink layer.

Support

Any material may be used as the support as long as it is well dimensionally stable and well resistant to heat at the time of the thermal head recording. Materials useful as the support include thin leaf papers such as condenser paper and glassine paper, and heat-resistant plastic films such as of polyethylene terephthalate, polyethylene naphthalate, polyamide, polyimide, polycarbonate, polysulfone, polyvinyl alcohol, cellophane and polystyrene.

The support is preferably 2 to 10 μm in thickness.

The support may take any form with no restriction, such as, e.g., a wide sheet or film, a wide tape or card, and the like.

Ink Layer

The above ink layer contains essentially a heat-diffusible dye and a binder.

1. Heat-Diffusible Dye

Examples of the heat-diffusible dye used in the invention include the cyan image-forming dye (hereinafter called cyan dye), magenta image-forming dye (hereinafter called magenta dye) and yellow image-forming dye (hereinafter called yellow dye), which are each capable of forming at least a bidentate chelate with the above metallic ion-containing compound, described in JP O.P.I. Nos. 78893/1984, 109349/1984, 213303/1990, 214719/1990 and 203742/1990.

The above dyes are preferably those represented by the following Formula 1:

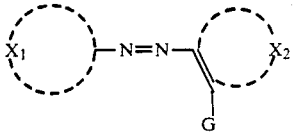

wherein $X_1$ represents a group of atoms necessary to complete aromatic carbocyclic rings or heterocyclic rings of which at least one ring has 5 to 7 carbon atoms, wherein at least one of the atoms adjacent to the carbon atom bonding to the azo linkage is a nitrogen atom or a carbon atom that is substituted by a chelating group: $X_2$ is an aromatic heterocyclic ring or aromatic carbocyclic ring comprised of 5 to 7 atoms; and G is a chelating group.

The heat-diffusible dye contained in the ink layer, if forming a monochromatic image, may be any one of the yellow, magenta or cyan dye.

Also, depending on the color of an image to be formed, the ink layer may contain any two of the above three different dyes or other heat-diffusible dyes.

The using amount of the above heat-diffusible dyes is normally 0.1 to 20 g/m$^2$, preferably 0.2 to 5 g/m$^2$.

2. Binder

Examples of the binder of the ink layer include cellulose resins such as cellulose-addition compounds, cellulose esters and cellulose ethers; polyvinyl alcohol, polyvinyl formal; polyvinyl acetal resins such as polyvinyl acetoacetal and polyvinyl butyral; polyvinyl pyrrolidone, polyvinyl acetate, polyacrylamide, styrene resins, poly(meth)acrylates, poly(meth)acrylic acid, vinyl resins such as (meth)acrylic acid copolymers, rubber resins, ionomer resins, olefin resins, and polyester resins.

The preferred among the above resins are polyvinyl butyral, polyvinyl acetoacetal and cellulose resins.

The above-mentioned various binders may be used alone or in combination. The binder:heat-diffusible dye ratio by weight is preferably 1:10 to 10:1, more preferably 2:8 to 7:3.

3. Other Arbitrary Constituents

Further, to the ink layer may be arbitrarily added various additives.

Examples of the additives include peelable compounds such as silicone resins, silicone oils (including those of the reaction-hardenable type), silicone-modified resins, fluororesins, surfactants and wax; fillers such as metallic powder, silica gel, metal oxides, carbon black and resin powder: and hardeners capable of reacting with a binder constituent (e.g., radiation-active compounds such as isocyanates, acrylates and epoxy compounds).

Also, as one of the additives there may be used a heat-meltable material for accelerating the transfer, e.g., a compound such as the wax or higher fatty acid ester described in JP O.P.I. No. 106997/1984.

Other Layer

The thermal transfer recording ink sheet composition is not limited to the double-layer structure comprised of the support and the ink layer, and is allowed to have an additional layer.

For example, an overcoat layer may be provided over the ink layer for the purpose of preventing possible occurrence of the blocking between the ink sheet and the image-receiving sheet.

Also, the support may have a subbing layer for the purpose of improving the adhesion of the binder thereto or preventing the transfer of the dye to the support side or dyeing the support.

Further, an antisticking layer may be provided on the reverse side of the support (opposite to the ink layer) in order to prevent possible sticking of the thermal head to the support or possible occurrence of creases on the thermal transfer recording ink sheet.

The above overcoat layer, subbing layer and antisticking layer each have a thickness of normally from 0.1 to 1 μm.

(4) Preparation of Thermal Transfer Recording Ink Sheet

The thermal transfer recording ink sheet can be prepared in the manner that the aforementioned constituents for forming an ink layer are dispersed or dissolved in a solvent to prepare an ink layer forming coating liquid, and this liquid is coated on a support and then dried.

The binder is used in the form of a latex prepared by dissolving a single or two or more kinds thereof in a solvent.

As the above solvent there may be used water, ethanol, tetrahydrofuran, methyl-ethyl ketone, toluene, xylene, chloroform, dioxane, acetone, cyclohexane and n-butyl acetate.

For the above coating there may be used conventionally known gravure-roll coating method, extrusion coating method, wire-bar coating method or roll coating method.

The ink layer may be formed over the entire area or a partial area of the support as a layer containing a monochromatic heat-diffusible dye or in the multilayer form comprising an yellow ink layer containing the binder and a yellow dye, a magenta ink layer containing the binder and a magenta dye and a cyan ink layer containing the binder and a cyan dye, which are arranged in a given order along the plane direction.

A black ink layer containing a black image-forming material may also be present in addition to the above three ink layers arranged along the plane direction.

As for the black ink layer, a clear image can be obtained in either the diffusible-transfer-type or the melt-transfer-type process.

The thickness of the ink layer formed is normally 0.2 to 10 μm, preferably 0.3 to 3 μm.

The thermal transfer recording ink sheet may be perforated or may have thereon detection marks for detecting the position of a different color area in order to provide facilities for use.

(5) Image Formation By Thermal Transfer Recording

To form an image, the ink layer of the thermal transfer recording ink sheet is brought into contact with the image-receiving layer of the thermal transfer recording image-receiving sheet, and thermal energy is imagewise applied to the interface between the ink layer and the image-receiving layer.

Then, the heat-diffusible dye in the ink layer is sublimed in an amount corresponding to the thermal energy applied at the time of image formation, and thus transferred to and received by the image-receiving layer, whereby a chelate dye image is formed in the image-receiving layer.

Formed in the image-receiving layer as the image is, in many cases the concentration of its heat-diffusible dye is generally high at the surface of the image-receiving layer, and the chelated heat-diffusible dye also is mostly present at the surface. In this instance, there are cases where no sufficient effect is obtained on the image preservability (such as light resistance) of the formed chelate dye image.

In the invention, at a portion closer to the support the concentration of the metallic ion-containing compound is higher, so the closer to the support, the larger the amount of the chelated heat-diffusible dye for the image formation is. However, at the time of the image formation, since the unchelated heat-diffusible dye can remain inside the image-receiving layer, the thermal transfer recording image-receiving sheet bearing a formed image is still subjected to heat treatment.

Thus, when the heat treatment after image formation is performed under the condition that the closer to the support, the larger amount of the metallic ion-containing compound is present, the unchelated heat-diffusible dye becomes sufficiently diffused to thus not only form a chelated, stably heat-diffused dye image but improve its fixation because there is little unchelated heat-diffusible dye remaining in the proximity of the surface, and furthermore prevent the dye's blur or bleedout due to light or heat, thus improving the light resistance, heat resistance and preservability of the resulting image.

Further, the surface form of the image-receiving layer can be discretionarily changed by applying pressure thereto with a pressing means at the time of heat treatment.

For the above heat treatment there may be used known heating means such as a commonly used heat roll, hot stamp, and other heat sources such as a thermal head, laser light, infrared flash, thermal pen and the like.

Of these heat sources when the thermal head is used, in order to protect the head, the image-bearing thermal transfer recording image-receiving sheet is preferably heated through an ink layer-free a rear-provided thermal transfer recording ink sheet or through a different heat-treatment sheet.

In any case, since the heat-diffusible dye must be diffused up to the support, it is necessary to provide sufficient thermal energy. Application of heat in the heat treatment. If sufficiently provided, may be made to the image-receiving layer surface side, the support side or both sides of the sheet, but, for efficiency, heat is preferably applied to the support side.

The heating temperature and time in the above heat treatment depend on the heat source used. The heat source used in the hereinafter-described image recording may be any one of the above heat sources, and the heat treatment may be made in the usual image recording manner.

The heating temperature when using a heat roll for the heat treatment is in the range of normally 70° to 200° C., preferably 100° to 150° C., and the transport speed is normally 0.01 to 20 mm/sec, preferably 0.05 to 10 mm/sec.

The heating temperature when using a hot stamp for the heat treatment is in the range of normally 50° to 200° C., preferably 80° to 150° C.; pressure applied is in the range of normally 0.05 to 20 kg/cm$^2$, preferably 0.5 to 5 kg/cm$^2$; and the heating time is normally 0.1 to 20 seconds, preferably 0.5 to 10 seconds.

The thermal head is generally used as a heat source to provide thermal energy for the above image formation, but aside from this, known heat sources such as laser light, infrared flash and thermal pen may also be used.

When the thermal head is used as a heat source, thermal energy to be provided can be changed continuously or by stages by modulating the voltage or pulse width to be applied to the thermal head.

When the laser light is used as a heat source, thermal energy to be provided can be changed by changing the amount or the radiation area of the laser light.

In the above case, in order to facilitate the absorption of laser light, a laser light absorbing material (e.g., in the case of a semiconductor laser light, carbon black, near infra-red-ray absorbing material, etc.) is preferably made present inside or in the proximity of the ink layer.

When the laser light is used, the thermal transfer recording ink sheet should be brought into close contact with the image-receiving sheet.

If an acoustic-optical element-built-in dot generator is used, it enables to provide thermal energy in intensities corresponding to halftone dot sizes.

When the infrared flash lamp is used as a heat source to provide thermal energy, heating should be made through a black pigment layer as in the case of using the laser light.

Alternatively, heating may also be made through an imagewise black pattern with continuous gradation or halftone dots or through a negative pattern corresponding to the above pattern in combination with a solid black-pigmented layer.

Thermal energy may be applied to the ink sheet side, to the image-receiving layer side or to both sides, but if the effective use of thermal energy is preferential, thermal energy should be applied to the ink sheet side.

The above thermal transfer recording operation enables monochromatic image recording on the image-receiving layer of the thermal transfer recording image-receiving sheet, but according to the following method, a color image comprising composite colors, similar to an ordinary color photographic image, can be obtained.

For example, if yellow, magenta, cyan and, if necessary, black thermal sheets for thermal transfer recording are used in turn to make sequential heat-transfer operations for the respective colors, then a color image comprising composite colors, similar to an ordinary color photo can be obtained.

Further, the use of thermal transfer recording ink sheets having sectional areas formed for different colors beforehand instead of using the above-mentioned thermal transfer recording ink sheets for different colors is also effective.

Firstly, the yellow area is used to make heat transfer of a separate yellow color image, then the magenta area is used to make heat transfer of a separate magenta color image, thus repeating this procedure in sequence to form heat-transferred separate yellow, magenta, cyan and, if necessary, black color images to thereby complete a full color image.

This method of course makes it possible to obtain an image like an ordinary color photo, and fortunately, this method is advantageous in that there is no need of the aforementioned replacement of the thermal sheet for thermal transfer recording.

EXAMPLES

The invention is illustrated further in detail by the following examples, but the invention is not limited thereto. In the following examples, the term 'part(s)' means part(s) by weight.

Example 1

Preparation of Thermal Transfer Recording Ink Sheet

On the corona-discharge-treated surface of a 6 μm-thick polyethylene terephthalate film support, produced by Toray Corp., an ink layer forming coating liquid having the following composition was coated by a wire-bar coating method and dried so as to have a dry thickness of 1 μm, and onto the untreated reverse side of the same support were dropwised added by a pipet one or two drops of a nitrocellulose solution containing a silicone resin SP-2105, produced by Dainichi Seika Co., to be spread over for backing coating of the entire area thereof, whereby a thermal transfer recording ink sheet was obtained.

| Ink layer forming coating liquid: | |
|---|---|
| Heat-diffusible dye, yellow dye having Formula 2 | 3 parts |
| Nitrocellulose (Cellunova BTH½, produced by Asahi Kasei Kogyo Co.) | 3 parts |
| Methyl-ethyl ketone | 44 parts |
| Dioxane | 40 parts |
| Cyclohexanone | 10 parts |

Formula 2

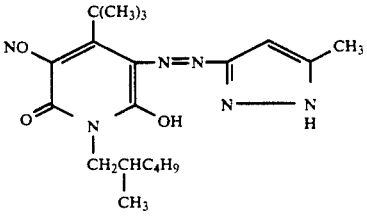

Preparation of Thermal Transfer Recording Image-Receiving Sheet

A synthetic paper Yupo FPG-150 of 150 μm in thickness, produced by Ohji Yuka Goseishi Co., was used as a support, and on the support were coated in sequence a coating liquid having the following composition for forming a lower sublayer of a image-receiving layer and a coating liquid having the following composition for forming a lower sublayer of the image-receiving layer so as to form on the support a 10 μm-thick lower sublayer and a 2 μm-thick upper sublayer of the image-receiving layer, whereby a thermal transfer recording image-receiving sheet was obtained.

| Image-receiving layer's lower sublayer coating liquid: | |
|---|---|
| Polyvinyl chloride resin, TK600 produced by Shin'etsu Kagaku Kogyo Co. | 6 parts |
| Metallic ion-containing compound $[[Ni(C_2H_5NHCH_2CH_2NH_2)]^{2+}[(C_6H_5)_4B]^{2-}]$ | 4 parts |
| Dioxane | 40 parts |
| Methyl-ethyl ketone | 40 parts |
| Cyclohexanone | 10 parts |
| Image-receiving layer's upper sublayer coating liquid: | |
| Epoxy resin, Epotohto YD-014 produced by Tohto Kasei Co. | 9.0 parts |
| Metallic ion-containing compound $[[Ni(C_2H_5NHCH_2CH_2NH_2)]^{2+}[(C_6H_5)_4B]^{2-}]$ | 0.5 part |
| Polyester-modified silicone resin, X-24-8300 produced by Shin'etsu Kagaku Kogyo Co. | 0.5 part |
| Methyl-ethyl ketone | 80.0 parts |
| Cyclohexanone | 10.0 parts |

Image Formation

Firstly, the above thermal transfer recording ink sheet and the thermal transfer recording image-receiving sheet were so superposed as to bring the ink layer surface into contact with the surface of the image-receiving layer, and then a thermal head was applied to the thermal transfer recording ink sheet from its support side under the following conditions to thereby form an image. Subsequently, the ink sheet and the image-receiving sheet were peeled apart, whereby the image was transferred onto the thermal transfer recording image-receiving sheet.

After the image recording, the transferred image density on the image-receiving layer, the heat resistance, light resistance, fixability and antiblur characteristic of the formed image were evaluated according to the following criteria. The results are shown in Table 1.

Main- and sub-scanning line density: 8 dots/mm.

Recording power: 0.6 W/dot.

Thermal head heating time: Heating time was adjusted by stages between 20 msec.(impressed energy: approximately $11.2\times10^{-3}$J) and 2 msec. (impressed energy: approximately $1.12\times10^{-3}$J).

Transfer Density

Reflection density OD value was measured with an optical densitometer.

A . . . OD value: not less than 2.5
B . . . OD value: 2.0 to less than 2.5
C . . . OD value: 1.7 to less than 2.0
D . . . OD value: less than 1.7

Heat Resistance (Image Preservability To Heat)

The image-recorded thermal transfer recording image-receiving sheet was allowed to stand for 72 hours under ambient conditions of 77° C. and 80% RH. The aged sample was evaluated by visually judging the presence of the bleedout, discoloration and faded degree of its dye and also by measuring them with a spectrophotometer and an optical densitometer.

A . . . No discoloration nor fading at all.
B . . . Slight discoloration and fading are recognized.
C . . . Discoloration and fading are recognized.
D . . . Discoloration and fading are conspicuous.

Light Resistance (Image Preservability to Light)

The image-recorded thermal transfer recording image-receiving sheet was exposed for 72 hours to the light of a xenon weather meter. After that the image was visually observed and the condition of its dye was measured with a spectrophotometer and an optical densitometer.

A . . . No discoloration nor fading at all.
B . . . Slight discoloration and fading are recognized.
C . . . Discoloration and fading are recognized.
D . . . Discoloration and fading are conspicuous.

Fixability of Dye

The image-recorded thermal transfer recording image-receiving sheet and a non-image-bearing thermal transfer recording image-receiving sheet of the invention were superposed with their image-receiving layers face-to-face in contact with each other, and to the superposed pair was applied a load of 40 g/cm$^2$ at 60° C. for 48 hours, and after that the fixability of the dye was judged according to the density of the dye transferred onto the non-image-bearing thermal transfer recording image-receiving sheet.

A . . . No transferred dye at all
B . . . Transferred dye density: less than 0.10
C . . . Transferred dye density: 0.10 to less than 0.15
D . . . Transferred dye density: not less than 0.15

Antiblur Characteristic of Dye

The image-recorded thermal transfer recording image-receiving sheet was allowed to stand at 60° C for one week, and after that the sheet was evaluated by visually judging the blurredness of the image.

A . . . Almost no blurredness recognized.
B . . . Blurredness recognized.

EXAMPLE 2

A thermal transfer recording image-receiving sheet was prepared in the same manner as in Example I except that the compositions of the coating liquid for forming the lower sublayer and the coating liquid for forming the upper sublayer of the image-receiving layer were replaced by the following compositions, and then the same ink sheet as in Example 1 was used to form an image and evaluate in the same manner as in Example 1. The results are shown in Table 1.

| | |
|---|---|
| Image-receiving layer's lower sublayer coating liquid: | |
| Polyvinyl chloride resin, TK300 produced by Shin'etsu Kagaku Kogyo Co. | 5.0 parts |
| Metallic ion-containing compound $[[Ni(C_2H_5NHCH_2CH_2NH_2)]^{2+}[(C_6H_5)_4B]^{2-}]$ | 4.0 parts |
| Alkyl phthalate, DOP produced by Daihachi Kagaku Co. | 1.0 part |
| Methyl-ethyl ketone | 80.0 parts |
| Cyclohexanone | 10.0 parts |
| Image-receiving layer's upper sublayer coating liquid: | |
| Phenoxy resin, Phenotohto YP-50 produced by Tohto Kasei Co. | 9.0 parts |
| Metallic ion-containing compound $[[Ni(C_2H_5NHCH_2CH_2NH_2)]^{2+}[(C_6H_5)_4B]^{2-}]$ | 0.5 part |
| Polyester-modified silicone resin. X-24-8300 produced by Shin'etsu Silicone Co. | 0.5 part |
| Dioxane | 80.0 parts |
| Cyclohexanone | 10.0 parts |

EXAMPLE 3

A thermal transfer recording image-receiving sheet was prepared in the manner that coating liquids having the compositions in the following prescription, wherein the amount X represents 3, 4.5, 6, 7.5 and 9 parts by weight which are in the described order from the support side, for forming image-receiving layer's lower sublayer and a coating liquid having the following composition for forming the upper sublayer of the image-receiving layer were coated in sequence on the support and dried so as to each have a dry thickness of 2 μm, and the thus obtained image-receiving sheet was tested with the use of the same ink sheet as in Example 1 to form an image for evaluation in the same manner as in Example 1. The results are shown in Table 1.

| | |
|---|---|
| Coating liquids for forming image-receiving layer's lower sublayer: | |
| Epoxy resin, Epotohto YD-014 produced by Tohto Kasei Co. | X parts |
| Metallic ion-containing compound $[[Ni(C_2H_5NHCH_2CH_2NH_2)]^{2+}[(C_6H_5)_4B]^{2-}]$ | 10-X parts |
| Methyl-ethyl ketone | 80.0 parts |
| Cyclohexanone | 10.0 parts |
| Coating liquid for forming image-receiving layer's upper sublayer: | |
| Phenoxy resin, Phenototo YP-50 produced by Tohto Kasei Co. | 9.0 parts |
| Metallic ion-containing compound $[[Ni(C_2H_5NHCH_2CH_2NH_2)]^{2+}[(C_6H_5)_4B]^{2-}]$ | 0.5 part |
| Polyester-modified silicone resin, X-24-8300 produced by Shin'etsu Kagaku Kogyo Co. | 0.5 part |
| Dioxane | 80.0 parts |
| Cyclohexanone | 10.0 parts |

EXAMPLE 4

In Example 1, after the formation of an image, the image-receiving sheet bearing the formed image was subjected to heat treatment in the manner of heating it by a heat roller from the side of its support at 120° C. and at a transport speed of 5 mm/sec, and then the image was evaluated. The results are shown in Table 1.

EXAMPLE 5

A thermal transfer recording image-receiving sheet was prepared in the same manner as in Example 1 except that the compositions of the coating liquid for forming the lower sublayer and the coating liquid for forming the upper sublayer of the image-receiving layer were replaced by the following compositions. The obtained image-receiving sheet and the ink sheet of Example 1 were used to form an image in the same manner as in Example 1, then the image-receiving sheet bearing the formed image was heated by a heat roller from the side of its support at 130° C. and at a transport speed of 5 mm/sec, and after that the produced image was evaluated. The results are shown in Table 1.

| | |
|---|---|
| Image-receiving layer's lower sublayer coating liquid: | |
| Polyvinyl chloride resin, TK600 produced by Shin'etsu Kagaku Kogyo Co. | 2.5 parts |
| Vinyl chloride resin, Esmedica V1330E produced by Sekisui Kagaku Kogyo Co. | 2.5 parts |
| Metallic ion-containing compound $[[Ni(C_2H_5NHCH_2CH_2NH_2)]^{2+}[(C_6H_5)_4B]^{2-}]$ | 5 parts |
| Methyl-ethyl ketone | 80.0 parts |
| Cyclohexanone | 10.0 parts |
| Image-receiving layer's upper sublayer coating liquid: | |
| Vinyl chloride resin, Esmedica V5142E produced by Sekisui Kagaku Kogyo Co. | 9.0 parts |
| Metallic ion-containing compound $[[Ni(C_2H_5NHCH_2CH_2NH_2)]^{2+}[(C_6H_5)_4B]^{2-}]$ | 0.5 part |
| Polyester-modified silicone resin, X-24-8300 | 0.5 part |
| Methyl-ethyl ketone | 80.0 parts |
| Cyclohexanone | 10.0 parts |

EXAMPLE 6

A thermal transfer recording image-receiving sheet was prepared in the same manner as in Example 1 except that the compositions of the coating liquid for forming the lower sublayer and the coating liquid for forming the upper sublayer of the image-receiving layer were replaced by the following compositions, and the obtained image-receiving sheet and the ink sheet of Example 1 were used to form an image in the same manner as in Example 1, and then the image-receiving sheet bearing the formed image was heated by a heat roller from the side of its support at 120° C. and at a transport speed of 5 mm/sec, and after that the produced image was evaluated. The results are shown in Table 1.

| | |
|---|---|
| Image-receiving layer's lower sublayer coating liquid: | |
| Epoxy resin, Epotohto YDF-2001 produced by Tohto Kasei Co. | 5.0 parts |
| Metallic ion-containing compound $[[Ni(C_2H_5NHCH_2CH_2NH_2)]^{2+}[(C_6H_5)_4B]^{2-}]$ | 5.0 parts |
| Methyl-ethyl ketone | 80.0 parts |
| Cyclohexanone | 10.0 parts |
| Image-receiving layer's lower sublayer coating liquid: | |
| Epoxy resin, Epotohto YP-017 produced by Tohto Kasei Co. | 9.0 parts |
| Metallic ion-containing compound $[[Ni(C_2H_5NHCH_2CH_2NH_2)]^{2+}[(C_6H_5)_4B]^{2-}]$ | 0.5 part |
| Polyester-modified silicone resin, X-24-8300 produced by Shin'etsu Kagaku Kogyo Co. | 0.5 part |
| Methyl-ethyl ketone | 80.0 parts |
| Cyclohexanone | 10.0 parts |

EXAMPLE 7

A thermal transfer recording image-receiving sheet was prepared in the same manner as in Example 1 except that the compositions of the coating liquid for forming the lower sublayer and the coating liquid for forming the upper sublayer of the image-receiving layer were replaced by the following compositions. The obtained image-receiving sheet and the ink sheet of Example 1 were used to form an image in the same manner as in Example 1, then the image-receiving sheet bearing the formed image was heated by a heat roller from the side of its support at 130° C. and at a transport speed of 5 mm/sec, and after that the produced image was evaluated. The results are shown in Table 1.

| | |
|---|---|
| Image-receiving layer's lower sublayer coating liquid: | |
| Epoxy resin, Epicoat 1001 produced by Yuka Shell Epoxy Co. | 5.0 parts |
| Metallic ion-containing compound $[[Ni(C_2H_5NHCH_2CH_2NH_2)]^{2+}[(C_6H_5)_4B]^{2-}]$ | 5.0 parts |
| Methyl-ethyl ketone | 80.0 parts |
| Cyclohexanone | 10.0 parts |
| Image-receiving layer's upper sublayer coating liquid: | |
| Vinyl chloride resin, VYHH produced by Union Carbide Corp. | 0.5 part |
| Polyester-modified silicone resin, X-24-8300 produced by Shin'etsu Kagaku Kogyo Co. | 0.5 part |
| Methyl-ethyl ketone | 80.0 parts |
| Cyclohexanone | 10.0 parts |

EXAMPLE 8

A thermal transfer recording image-receiving sheet was prepared in the same manner as in Example 1 except that the composition of the coating liquid for forming the upper sublayer of the image-receiving layer was replaced by the following composition. The obtained image-receiving sheet and the ink sheet of Example 1 were used to form an image in the same manner as in Example 1, then the image-receiving sheet bearing the formed image was heated by a heat roller from the side of its support at 120° C. and at a transport speed of 3 mm/sec. and after that the produced image was evaluated. The results are shown in Table 1.

| | |
|---|---|
| Image-receiving layer's upper sublayer coating liquid: | |
| Epoxy resin, Epotohto YD-014 produced by Tohto Kasei Co. | 9.5 parts |
| Polyester-modified silicone resin, X-24-8300 produced by Shin'etsu Kagaku Kogyo Co. | 0.5 part |
| Methyl-ethyl ketone | 80.0 parts |
| Cyclohexanone | 10.0 parts |

EXAMPLE 9

A thermal transport recording image-receiving sheet was prepared in the same manner as in Example 1 except that the composition of the coating liquid for forming the upper sublayer of the image-receiving layer was replaced by the following composition, and over the image-receiving layer was coated a coating liquid having the following composition for forming an overcoat layer and then dried to thereby provide an overcoat layer having a dry thickness of 1 μm. The obtained image-receiving sheet and the ink sheet of Example 1 were used to form an image in the same manner as in Example 1, then the image-receiving sheet bearing the formed image was heated by a heat roller from the side of its support at 130° C. and at a transport speed of 3 mm/sec, and after that the produced image was evaluated. The results are shown in Table 1.

| | |
|---|---|
| Image-receiving layer's upper sublayer coating liquid: | |
| Epoxy resin, Epotohto YD-012 produced by Tohto Kasei Co. | 7.0 parts |
| Metallic ion-containing compound $[[Ni(C_2H_5NHCH_2CH_2NH_2)]^{2+}[(C_6H_5)_4B]^{2-}]$ | 3.0 parts |
| Dioxane | 40.0 parts |
| Methyl-ethyl ketone | 40.0 parts |
| Cyclohexanone | 10.0 parts |
| Overcoat layer coating liquid: | |
| Vinyl chloride resin, Ryuron QC-640 produced by Toso Co. | 9.5 parts |
| Polyester-modified silicone resin, X-24-8300 produced by Shin'etsu Kagaku Kogyo Co. | 0.5 part |
| Methyl-ethyl ketone | 80.0 parts |
| Cyclohexanone | 10.0 parts |

EXAMPLE 10

A thermal transfer recording image-receiving sheet was prepared in the same manner as in Example 1 except that the composition of the coating liquid for forming the upper sublayer of the image-receiving layer was replaced by the following composition. The obtained image-receiving sheet and the ink sheet of Example 1 were used to form an image in the same manner as in Example 1, then the image-receiving sheet bearing the formed image was heated by a heat roller from the side of its support at 120° C. and at a transport speed of 5 mm/sec, and after that the produced image was evaluated. The results are shown in Table 1.

| | |
|---|---|
| Image-receiving layer's upper sublayer coating liquid: | |
| Vinyl chloride resin, Esmedica V 1330E produced by Sekisui Kagaku Co. | 7.5 parts |
| Metallic ion-containing compound $[[Ni(C_2H_5NHCH_2CH_2NH_2)]^{2+}[(C_6H_5)_4B]^{2-}]$ | 0.5 part |
| Polyester-modified silicone resin, X-24-8300 produced by Shin'etsu Kagaku Kogyo Co. | 0.5 part |
| UV absorbent, Uvinul N-35 produced by BASF Corp. | 1.5 parts |
| Methyl-ethyl ketone | 80.0 parts |
| Cyclohexanone | 10.0 parts |

EXAMPLE 11

A thermal transfer recording image-receiving sheet was prepared in the same manner as in Example 1 except that the compositions of the coating liquids for forming the lower and upper sublayers of the image receiving layer were replaced by the following compositions, and on the upper sublayer was coated an overcoat layer forming liquid of the following composition and then dried to thereby form an overcoat layer having a dry thickness of1 μm. The obtained image-receiving sheet and the ink sheet of Example 1 were used to form an image in the same manner as in Example 1, then the image-receiving sheet bearing the formed image was heated by a heat roller from the side of its support at 130° C. and at a transport speed of 3 mm/sec, and after that the produced image was evaluated. The results are shown in Table 1.

| | |
|---|---|
| Image-receiving layer's lower sublayer coating liquid: | |
| Polyvinyl chloride resin, TK300 produced by Shin'etsu Kagaku Kogyo Co. | 2 parts |

-continued

| | |
|---|---|
| Epoxy resin, Epicoat 1001 produced by Yuka Shell Epoxy Co. | 2 parts |
| Alkyl phtahalate, DOP produced by Daihachi Kagaku Co. | 1 part |
| Metallic ion-containing compound $[[Ni(C_2H_5NHCH_2CH_2NH_2)]^{2+}[(C_6H_5)_4B]^{2-}]$ | 5 parts |
| Methyl-ethyl ketone | 80 parts |
| Cyclohexanone | 10 parts |
| Image-receiving layer's upper sublayer coating liquid: | |
| Vinyl chloride resin, VYHH produced by Union Carbide Corp. | 8.0 parts |
| Metallic ion-containing compound $[[Ni(C_2H_5NHCH_2CH_2NH_2)]^{2+}[(C_6H_5)_4B]^{2-}]$ | 2.0 parts |
| Methyl-ethyl ketone | 80.0 parts |
| Cyclohexanone | 10.0 parts |
| Overcoat layer coating liquid: | |
| Vinyl chloride resin, Ryuron QC-640 produced by Toso Co. | 8.0 parts |
| Polyester-modified silicone resin, X-24-8300 produced by Shin'etsu Kagaku Kogyo Co. | 0.5 part |
| UV absorbent, Uvinul N-35 produced by BASF Corp. | 1.5 parts |
| Methyl-ethyl ketone | 80.0 parts |
| Cyclohexanone | 10.0 parts |

EXAMPLE 12

In Example 1, after the formation of an image, heat treatment was made by use of a hot stamp at 120° C. for 5 seconds with application of pressure of 1.5 kg/cm$^2$, and after that the produced image was evaluated. The results are shown in Table 2.

EXAMPLE 13

In Example 3, after the formation of an image, heat treatment was made by use of a hot stamp at 120° C. for 5 seconds with application of pressure of 1 kg/cm$^2$, and after that the formed image was evaluated. The results are shown in Table 2.

EXAMPLE 14

A thermal transfer recording image-receiving sheet was prepared in the same manner as in Example 1 except that the compositions of the coating liquid for forming the lower sublayer and the coating liquid for forming the upper sublayer of the image-receiving layer were replaced by the following compositions. The obtained image-receiving sheet and the ink sheet of Example 1 were used to form an image in the same manner as in Example 1, then the image-receiving sheet bearing the formed image was heated by an infrared flash lamp radiating from the side of its support, and after that the image was evaluated. The results are shown in Table 2.

| | |
|---|---|
| Image-receiving layer's lower sublayer coating liquid: | |
| Vinyl chloride-isobutylvinyl ether copolymer Laroflex MP25, product of BASF Corp. | 3.9 parts |
| Metallic ion-containing compound $[[Ni(C_2H_5NHCH_2CH_2NH_2)]^{2+}[(C_6H_5)_4B]^{2-}]$ | 5.0 parts |
| Alkyl trimellitate, ADK CIZER C79 produced by Adeka Argus Chemical Co. | 1.0 part |
| UV absorbent, Kayasoap CY-9 produced by Nippon Kayaku Co. | 0.1 part |
| Methyl-ethyl ketone | 80.0 parts |
| Cyclohexanone | 10.0 parts |
| Image-receiving layer's upper sublayer coating liquid: | |
| Epoxy resin, Epotohto YD-7011 produced by Tohto Kasei Co. | 6.0 parts |
| Polyvinyl chloride resin, TK300 produced by Shin'etsu Kagaku Kogyo Co. | 3.0 parts |
| Metallic ion-containing compound | 0.5 parts |

-continued

| | |
|---|---|
| $[[Ni(C_2H_5NHCH_2CH_2NH_2)]^{2+}[(C_6H_5)_4B]^{2-}]$ | |
| Polyester-modified silicone resin, X-24-8300 produced by Shin'etsu Kagaku Kogyo Co. | 0.5 part |
| UV absorbent, Kayasoap CY-9 produced by Nippon Kayaku Co. | 0.01 part |
| Methyl-ethyl ketone | 80.0 parts |
| Cyclohexanone | 10.0 parts |

EXAMPLE 15

A thermal transfer recording image-receiving sheet was prepared in the same manner as in Example 1 except that the compositions of the coating liquid for forming the lower sublayer and the coating liquid for forming the upper sublayer were replaced by the following compositions. The obtained image-receiving sheet and the ink sheet of Example 1 were superposed with their image-receiving layer surface and ink layer surface in contact with each other, and the superposed pair was radiated by an approximately 80 μm-diameter concentrated beam of a semiconductor laser LT090MD/MF (wavelength: 830 nm, maximum light output: 100 mw, manufactured by Sharp Co.) emitting from the side of the support of the ink sheet to thereby form an image, and the thus obtained image was evaluated. The results are shown in Table 2.

| | |
|---|---|
| Image-receiving layer's lower sublayer coating liquid: | |
| Phenoxy resin, PKHH produced by Union Carbide Corp. | 4.8 parts |
| Metallic ion-containing compound $[[Ni(C_2H_5NHCH_2CH_2NH_2)]^{2+}[(C_6H_5)_4B]^{2-}]$ | 4.0 parts |
| Near infrared absorbent, SIR-103 produced by Mitsuitoatsu Senryo Co. | 0.2 part |
| Alkyl phtahalate, DOP produced by Daihachi Kagaku Co. | 1.0 part |
| Methyl-ethyl ketone | 40.0 parts |
| Cyclohexanone | 10.0 parts |
| Image-receiving layer's upper sublayer coating liquid: | |
| Vinyl chloride resin, Ryuron QC-640 produced by Toso Co. | 8.95 parts |
| Metallic ion-containing compound $[[Ni(C_2H_5NHCH_2CH_2NH_2)]^{2+}[(C_6H_5)_4B]^{2-}]$ | 0.5 part |
| Near infrared absorbent, SIR-103 produced by Mitsuitoatsu Senryo Co. | 0.05 part |
| Polyester-modified silicone resin, X-24-8300 produced by Shin'etsu Kagaku Kogyo Co. | 0.5 part |
| Methyl-ethyl ketone | 80.0 parts |
| Cyclohexanone | 10.0 parts |

EXAMPLE 16

A thermal transfer recording image-receiving sheet was prepared in the same manner as in Example 1 except that the compositions of the coating liquid for forming the lower sublayer and the coating liquid for forming the upper sublayer of the image-receiving layer were replaced by the following compositions. The obtained image-receiving sheet and the ink sheet of Example 1 were used to form an image by a semiconductor laser beam in the same manner as in Example 15, then the image-receiving sheet bearing the formed image was subjected to heat treatment with a near infrared flash lamp radiating from the side of its support, and after that the formed image was evaluated. The results are shown in Table 2.

| | |
|---|---|
| Image-receiving layer's lower sublayer coating liquid: | |
| Epoxy resin, Epicoat 1001 produced by Yuka Shell Epoxy Co. | 4.8 parts |
| Metallic ion-containing compound $[[Ni(C_2H_5NHCH_2CH_2NH_2)]^{2+}[(C_6H_5)_4B]^{2-}]$ | 4.0 parts |
| Near infrared absorbent, SIR-103 produced by Mitsuitoatsu Senryo Co. | 0.2 part |
| Alkyl phtahalate, DOP produced by Daihachi Kagaku Co. | 1.0 part |
| Methyl-ethyl ketone | 80.0 parts |
| Cyclohexanone | 10.0 parts |
| Image-receiving layer's upper sublayer coating liquid: | |
| Vinyl chloride resin, VYHH produced by Union Carbide Corp. | 7.45 parts |
| Metallic ion-containing compound $[[Ni(C_2H_5NHCH_2CH_2NH_2)]^{2+}[(C_6H_5)_4B]^{2-}]$ | 0.5 part |
| Near infrared absorbent, SIR-103 produced by Mitsuitoatsu Senryo Co. | 0.05 part |
| Polyester-modified silicone resin, X-24-8300 produced by Shin'etsu Kagaku Kogyo Co. | 0.5 part |
| UV absorbent, Uvinul N-35 produced by BASF Corp. | 1.5 parts |
| Methyl-ethyl ketone | 80.0 parts |
| Cyclohexanone | 10.0 parts |

EXAMPLE 17

A thermal transfer recording image-receiving sheet was prepared in the same manner as in Example 1 except that on the surface of the image-receiving sheet that was prepared in Example 1 was coated a coating liquid for the image-receiving layer's uppermost sublayer containing a peeling agent of the following composition to form the uppermost sublayer of 1.5 μm in dry thickness, and this image-receiving sheet and the same thermal transfer ink sheet as in Example 1 were used to form an image for evaluation in the same manner as in Example 1. The results are shown in Table 2.

| | |
|---|---|
| Image-receiving layer's uppermost sublayer coating liquid: | |
| Polyvinyl chloride resin, TK300 produced by Shin'etsu Kagaku Kogyo Co. | 7.5 parts |
| UV absorbent, 2-(3,5-di-t-butyl-2-hydroxy-phenyl)benzotirazole, TINUVIN 320 produced by Ciba Geigy Co. | 2.0 parts |
| Polyester-modified silicone resin, X-24-8300 produced by Shin'etsu Kagaku Kogyo Co. | 0.5 part |
| Methyl-ethyl ketone | 75 parts |
| Cyclohexanone | 15 parts |

EXAMPLE 18

A thermal transfer recording image-receiving sheet was prepared in the same manner as in Example 1 except that the image-receiving layer's upper sublayer coating liquid was replaced by one having the following composition, and this image-receiving sheet and the same thermal transfer ink sheet as in Example 1 were used to form an image for evaluation in the same manner as in Example 1. The results are shown in Table 3.

Image-receiving layer's upper sublayer coating liquid:

35% aqueous solution of polyethylene wax emulsion Hitech E-1000, produced by Toho Kagaku Co.

EXAMPLE 19

A thermal transfer recording image-receiving sheet was prepared in the same manner as in Example 1 except that the image receiving layer's upper sublayer coating liquid was replaced by one having the following composition, and this image-receiving sheet and the same thermal transfer ink sheet as in Example 1 were used to form an image for evaluation in the same manner as in Example 1. The results are shown in Table 3.

Image-receiving layer's upper sublayer coating liquid:

Polyester modified silicone resin X-24-8300, produced by Shin'etsu Kagaku Kogyo Co.

EXAMPLE 20

A thermal transfer recording image-receiving sheet was prepared in the same manner as in Example 1 except that the coating liquids for the formation of the upper and lower sublayers of the image-receiving layer were replaced by ones comprising the following compositions, and this image-receiving sheet and the same thermal transfer ink sheet as in Example 1 were used to form an image for evaluation in the same manner as in Example 1. The results are shown in Table 3.

| | |
|---|---|
| Image-receiving layer's lower sublayer coating liquid: | |
| Polyvinyl butyral resin Eslec BX-1, produced by Sekisui Kagaku Kogyo Co. | 5.0 parts |
| Metallic ion-containing compound, the same as in Example 1 | 5.0 parts |
| Methyl-ethyl ketone | 72.0 parts |
| Cyclohexanone | 18.0 parts |
| Image-receiving layer's upper sublayer coating liquid: | |
| 35% aqueous solution of polyethylene wax Hitech E-1000, produced by Toho Kagaku Co. | |

The thermal transfer recording image-receiving sheet samples prepared in Examples 18 to 20 and Comparative example 2 were each evaluated for the recording surface glossiness, presence of binder transfer (fusion), transfer density and light resistance thereof. The results are shown in Table 3. Regarding the transfer density, the blue-light reflection density of each sample was measured with a densitometer PDA-65, manufactured by KONICA Corp.

COMPARATIVE EXAMPLE 1

A thermal transfer recording image-receiving sheet was prepared in the same manner as in Example 1 except that the compositions of the coating liquid for forming the lower sublayer and the coating liquid for forming the upper sublayer were replaced by the following compositions. The obtained image-receiving sheet and the ink sheet of Example 1 were used to form an image in the same manner as in Example 1, and the thus obtained image was evaluated. The results are shown in Table 2.

| | |
|---|---|
| Image-receiving layer's lower sublayer coating liquid: | |
| Polyvinyl chloride resin, TK600 produced by Shin'etsu Kagaku Kogyo Co. | 9.5 parts |
| Metallic ion-containing compound $[[Ni(C_2H_5NHCH_2CH_2NH_2)]^{2+}[(C_6H_5)_4B]^{2-}]$ | 0.5 part |
| Methyl-ethyl ketone | 80.0 parts |
| Cyclohexanone | 10.0 parts |
| Image-receiving layer's upper sublayer coating liquid: | |
| Epoxy resin, Epotohto YD-014 produced by Tohto Kasei Co. | 5.5 parts |
| Metallic ion-containing compound $[[Ni(C_2H_5NHCH_2CH_2NH_2)]^{2+}[(C_6H_5)_4B]^{2-}]$ | 4.0 parts |
| Polyester-modified silicone resin, X-24-8300 produced by Shin'etsu Kagaku Kogyo Co. | 0.5 part |
| Methyl-ethyl ketone | 80.0 parts |
| Cyclohexanone | 10.0 parts |

COMPARATIVE EXAMPLE 2

A thermal transfer recording image-receiving sheet was prepared in the same manner as in Example 1 except that the compositions of the coating liquid for forming the lower sublayer and the coating liquid for forming the upper sublayer of the image-receiving layer were replaced by the following compositions. The obtained image-receiving sheet and the ink sheet of Example 1 were used to form an image in the same manner as in Example 1, and then the produced image was evaluated. The results are shown in Table 2.

| | |
|---|---|
| Image-receiving layer's lower sublayer coating liquid: | |
| Polyvinyl chloride resin, TK600 produced by Shin'etsu Kagaku Kogyo Co. | 6.0 parts |
| Metallic ion-containing compound $[[Ni(C_2H_5NHCH_2CH_2NH_2)]^{2+}[(C_6H_5)_4B]^{2-}]$ | 4.0 part |
| Methyl-ethyl ketone | 80.0 parts |
| Cyclohexanone | 10.0 parts |
| Image-receiving layer's upper sublayer coating liquid: | |
| Epoxy resin, Epotohto YD-014 produced by Tohto Kasei Co. | 5.5 parts |
| Metallic ion-containing compound $[[Ni(C_2H_5NHCH_2CH_2NH_2)]^{2+}[(C_6H_5)_4B]^{2-}]$ | 4.0 parts |
| Polyester-modified silicone resin, X-24-8300 produced by Shin'etsu Kagaku Kogyo Co. | 0.5 part |
| Methyl-ethyl ketone | 80.0 parts |
| Cyclohexanone | 10.0 parts |

COMPARATIVE EXAMPLE 3

In Example 1, after the formation of an image, the image-receiving sheet was subjected to heat treatment with a heat roller heating it from the side of its support at 120° C. and at a transport speed of 5 mm/sec, and after that the formed image was evaluated. The results are shown in Table 2.

COMPARATIVE EXAMPLE 4

In Example 2, after the formation of an image. the image-receiving layer was subjected to heat treatment with a heat roller heating it from the side of its support at 120° C. and at a transport speed of 5 mm/sec, and after that the formed image was evaluated. The results are shown in Table 2.

COMPARATIVE EXAMPLE 5

A thermal transfer recording image-receiving sheet was prepared in the same manner as in Example 1 except that the upper sublayer was excluded from the image-receiving layer, and this image-receiving sheet and the same thermal transfer ink sheet as in Example 1 were used to form an image for evaluation in the same manner as in Example I. The results are shown in Table 2.

COMPARATIVE EXAMPLE 6

A thermal transfer recording image-receiving sheet was prepared in the same manner as in Example 1 except that the same composition-having coating liquid was used for the formation of both the upper sublayer and lower sublayer of the image-receiving layer, and this image-receiving sheet and the same thermal transfer ink sheet as in Example 1 were used to form an image for evaluation in the same manner as in Example 1. The results are shown in Table 2.

TABLE 1

| | Transfer density | Heat resistance | Light resistance | Fixability | Blurredness |
|---|---|---|---|---|---|
| Example 1 | A | B | B | B | A |
| Example 2 | A | B | B | B | A |
| Example 3 | A | B | B | B | A |
| Example 4 | A | B | B | A | A |
| Example 5 | A | A | B | A | A |
| Example 6 | A | B | B | A | A |
| Example 7 | A | A | B | A | A |
| Example 8 | A | A | B | A | A |
| Example 9 | A | B | B | A | A |
| Example 10 | A | A | A | A | A |

TABLE 2

| | Transfer density | Heat resistance | Light resistance | Fixability | Blurredness |
|---|---|---|---|---|---|
| Example 11 | A | A | A | A | A |
| Example 12 | A | A | B | A | A |
| Example 13 | A | A | B | A | A |
| Example 14 | A | A | B | A | A |
| Example 15 | A | B | B | B | A |
| Example 16 | A | A | A | A | A |
| Example 17 | A | B | A | B | B |
| Comp. ex. 1 | B | C | D | B | A |
| Comp. ex. 2 | B | B | C | B | A |
| Comp. ex. 3 | B | B | D | B | A |
| Comp. ex. 4 | B | B | C | B | A |
| Comp. ex. 5 | B | C | C | B | B |
| Comp. ex. 6 | B | C | C | B | B |

TABLE 3

| | Surface glossiness | Fusion | Transfer density | Light resistance |
|---|---|---|---|---|
| Example 18 | B | None at all | 2.69 | A |
| Example 19 | A | None at all | 2.58 | B |
| Example 20 | B | None at all | 2.75 | A |
| Comp. ex. 2 | C | Found partially on the recording surface | 2.04 | C |

What is claimed is:

1. A thermal transfer recording image-receiving sheet comprising a support and provided thereon, an image receiving layer comprising a binder and a metallic ion-containing compound, wherein a concentration of the metallic ion-containing compound at a portion closer to the support is higher than that of the metallic ion-containing compound at a portion farther from the support.

2. The sheet of claim 1, wherein the metallic ion-containing compound is a compound represented by the following formula, $$[M(Q_1)_k(Q_2)_m(Q_3)_n]^{p+}.p(L^{-1})$$

wherein M represents a metallic ion, $Q_1$, $Q_2$ and $Q_3$ each represent an coordination compound capable of coordinate-bonding with a metallic ion represented by M, L represents an anion capable of forming a complex, k is an integer of 1, 2 or 3, m is an integer of 1, 2 or 0, n is an integer of 1 or 0, and p is an integer of 1, 2 or 3.

3. The sheet of claim 2, wherein M in said formula is selected from the group consisting of Ni, Cu, Co, Cr and Zn.

4. The sheet of claim 1, wherein a total content of the metallic ion-containing compound in the image receiving layer is 0.5 to 20 $g/m^2$.

5. The sheet of claim 1, wherein the image receiving layer is composed of a plurality of sublayers.

6. The sheet of claim 5, wherein a concentration of the metallic ion-containing compound in an outermost sublayer of the plurality of sublayers is substantially zero, and said outermost sublayer is the farthest from said support.

7. The sheet of claim 1, wherein the image receiving layer is composed of a first sublayer containing the metallic ion-containing compound and a second sublayer substantially not containing the metallic ion-containing compound, and said second sublayer is closer to said support than said first sublayer.

8. A thermal transfer recording method comprising the steps of;

superposing a thermal transfer recording image-receiving sheet upon a thermal transfer recording ink sheet comprising a support having thereon a heat-diffusible dye-containing ink layer, so that the image receiving layer comes into contact with the ink layer, imagewise applying heat to the superposed materials to transfer the ink layer to the image-receiving sheet and form the image on the image-receiving sheet, applying heat to the formed image, and peeling apart the ink sheet from the superposed materials, said thermal transfer recording image-receiving sheet comprising a support and provided thereon, an image receiving layer comprising a binder and a metallic ion-containing compound, wherein a concentration of the metallic ion-containing compound is higher at a portion closer to the support.

9. The method of claim 8, wherein pressure is applied at the same time of said applying heat to the formed image.

* * * * *